US011007389B1

(12) United States Patent
Foreman

(10) Patent No.: US 11,007,389 B1
(45) Date of Patent: May 18, 2021

(54) PORTABLE STORAGE CONTAINING APPARATUS AND METHOD OF USING SAME

(71) Applicant: Trinity Rental Services, LLC, Lafayette, LA (US)

(72) Inventor: Jonathan Foreman, Lafayette, LA (US)

( * ) Notice: Subject to any disclaimer, the term of this patent is extended or adjusted under 35 U.S.C. 154(b) by 202 days.

(21) Appl. No.: 16/380,136

(22) Filed: Apr. 10, 2019

Related U.S. Application Data

(60) Provisional application No. 62/655,448, filed on Apr. 10, 2018.

(51) Int. Cl.
*A62C 3/06* (2006.01)
*A62C 37/00* (2006.01)
*A62C 35/02* (2006.01)

(52) U.S. Cl.
CPC ..... *A62C 3/06* (2013.01); *A62C 35/023* (2013.01); *A62C 37/00* (2013.01)

(58) Field of Classification Search
CPC ..... A62C 3/06; A62C 35/023; A62C 37/00
USPC ..... 169/26, 47, 54, 9, 11, 60, 66, 70, 46
See application file for complete search history.

(56) References Cited

U.S. PATENT DOCUMENTS

| | | | | |
|---|---|---|---|---|
| 2,502,452 | A * | 4/1950 | Grant, Jr. | A62C 99/0027 169/11 |
| 5,178,973 | A * | 1/1993 | Binder | H01M 10/52 429/53 |
| 8,752,640 | B1 * | 6/2014 | Pottlitzer | A62C 3/002 169/46 |
| 10,670,322 | B2 * | 6/2020 | Eddy | F25B 9/006 |
| 2012/0199370 | A1 * | 8/2012 | Eckholm | A62C 37/38 169/46 |
| 2013/0065082 | A1 * | 3/2013 | Soto | B65D 90/22 428/665 |
| 2014/0209331 | A1 * | 7/2014 | Burkett | A62C 8/00 169/46 |
| 2017/0120089 | A1 * | 5/2017 | Fisher | A62C 35/10 |

* cited by examiner

*Primary Examiner* — Steven J Ganey
(74) *Attorney, Agent, or Firm* — Ted M. Anthony; Sarah B. Dupont

(57) ABSTRACT

A portable storage containing apparatus for use in safely storing a variety of different sensitive and/or flammable products. A portable storage containing apparatus for use in providing a localized fire extinguishing and suppression mechanism in an emergency situation. A portable storage containing apparatus comprising a manual release cabinet having a carbon dioxide fire suppression system for fire suppression of easily ignitable flammable materials. A portable storage containing apparatus comprising a flame arrested for use in preventing passage of flame, while simultaneously allowing for free ventilation.

3 Claims, 6 Drawing Sheets

PORTABLE STORAGE CONTAINING APPARATUS AND METHOD OF USING SAME

CROSS REFERENCES TO RELATED APPLICATION

Priority of U.S. Provisional Patent Application Ser. No. 62/655,448, filed Apr. 10, 2018, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

Field of the Invention

The present invention pertains to a portable container apparatus for use in safely storing a variety of different flammable and chemical products, generally on a facility in the oil and gas industry, such as, for example, an offshore platform. More particularly, the present invention pertains to a portable storage containing device for use in fire containment, fire extinguishing and fire suppression within a controlled location during an emergency situation.

Brief Description of the Prior Art

The risk of fire is present during all stages and operations within the petroleum industry, whether during exploration and production (E&P) both in onshore and offshore installations or during refining/processing or transportation, storage or during dispensing to an end user. All petroleum products from crude to final products produce vapor that is being mixed with air creating the potential for an ignitable mixture. While petroleum products have different rates of releasing vapors to the environment, they all share the risk of starting a fire when an ignition source is introduced to the mixture. Oil and gas production platforms constantly deal with inflammable materials. As a result, fire prevention, protection and mitigation measures are considered to be of utmost importance and are most advanced within the oil and gas industry in relation to the same measures taken in other industries.

Fire is a rapid chemical change that releases heat and light and is accompanied by a flame, especially during an exothermic oxidation of a flammable and/or combustible material. For a fire to start, three elements must generally be present simultaneously: (1) a combustible material (such as, a solid, a liquid or a gas); (2) a supply of air (oxygen) that is necessary for the combustion process; and (3) introduction of an ignition source (such as, a flame, a spark, static electricity, heat, etc.).

To extinguish a fire, one or more of the three fire elements has to be eliminated, such as, for example, by introducing carbon dioxide. Just like gases and vapors, liquids can also be a fire hazard, wherein an operation's resource liquids and waste liquids can sometimes catch fire. As such, OSHA has issued safety bulletins highlighting the issues presented by bulk transfer of flammable liquids (such as, for example, paint and/or other sensitive liquid materials), which are sometimes overlooked.

Conventional methods of fire suppression are generally certified by the American Bureau of Shipping (ABS) on permanent offshore structures. However, the bulk transfer of flammable liquids is typically done via an offshore container. As such, there is a need for an ABS certified fire suppression system on a temporary, or "movable," storage container. Offshore Containers are primarily used in the oil and gas industry due to their ability to withstand the harsh environment and handling of the offshore industry. However, offshore containers typically have to meet a variety of rigorous standards and certifications prior to being used in the oil and gas industry.

The primary standard in certification for offshore containers is by Det Norske Veritas (DNV). Det Norske Veritas (DNV) is an autonomous and independent foundation with the objectives of safeguarding life, property and the environment, at sea and onshore. DNV undertakes classification, certification, and other verification and consultancy services relating to quality of ships, offshore units and installations, and onshore industries worldwide, and carries out research in relation to these functions. Offshore service containers are generally exposed to rough handling during transportation. As such, one of the aims of the DNV Standard for Certification is to ensure that a container and its equipment are arranged and protected in order to avoid damage.

The Standard for Certification for offshore containers is DNV 2.7-1. This standard defines minimum technical and safety related requirements that are to be used as a basis for which to classify and certify offshore containers, as mandated by the International Maritime Dangerous Goods (IMDG) code. As such, an offshore container subject to DNV Certification has been certified in accordance with DNV's Standards, including design assessment, manufacturing/testing surveillance and final inspection by DNV. This ensures that these offshore containers are manufactured with consistency and sturdiness that is instrumental in epitomizing a high level of safety and quality that is expected by customers, vendors, end-users and any other interested party in the oil and gas industry.

SUMMARY OF THE INVENTION

The present invention comprises a portable storage containing apparatus for use in safely housing and storing a variety of different types of sensitive materials, such as, flammable and chemical materials and products on an offshore platform in the oil and gas industry, or any other similar type of environment and industry. Said storage containing apparatus is portable, thereby said apparatus is able to be transported onto an offshore platform location and then beneficially removed from said platform in order to transport said flammable and chemical material to an alternate location in the event of an emergency situation wherein said offshore platform would need to be abandoned. The storage containing apparatus of the present invention generally comprises a fire extinguishing system for use in fire suppression of relatively easily-ignitable flammables during a variety of different emergency situations.

The portable storage containing apparatus of the present invention generally comprises a container member having a base, a top, a plurality of side walls, and a plurality of end members, wherein said base, said top, said sides, and said ends cooperate to form an inner chamber. Said inner chamber comprises a plurality of shelving units, wherein said shelving units are installed within said inner chamber of said container member in a manner designed to store and hold said flammable and chemical materials, such as, for example, paint. As such, capable of storing over five hundred (500) gallons of paint or other similar chemical additives, said storage containing apparatus is intended to blend easily into an offshore platform's existing fire and safety plan and procedure.

Additionally, said storage containing apparatus of the present invention comprises a fire extinguishing system, wherein said fire extinguishing system further comprises a releasing cabinet and a carbon dioxide fire suppression system. Said releasing cabinet is located on an exterior of said container member for use in activation of said carbon dioxide fire suppression system. Moreover, said storage apparatus comprises a flame arrestor that is located on said top of said container member and is typically used to prevent the passage of flame(s), while concurrently allowing for free ventilation from said apparatus of the present invention. Activation of said fire extinguishing system of said storage containing apparatus of the present invention is generally achieved manually by way of engaging said releasing cabinet. Said releasing cabinet is typically engaged by pulling an activator handle located on a control panel, wherein an alarm and a carbon dioxide fire suppression system are then able to activate carbon dioxide discharge.

In an alternate embodiment, storage containing apparatus comprises a back-up method of manual activation for said fire suppression system. In the event said releasing cabinet fails to engage, said fire suppression system must be manually activated, wherein a safety pin from a manual activation valve located on a carbon dioxide bottle will be removed and an additional handle will be pulled in order to engage the carbon dioxide fire suppression system, thereby activating carbon dioxide discharge, which in turn will ultimately suppress a fire within said inner chamber of said container of the present invention.

Portable storage containing apparatus of the present invention allows for a number of advantages, including, but not limited to, minimizing footprints, avoiding trucking permit loads, protecting a variety of different sensitive components, interchangeability with a variety of different sized containers, and maintaining and complying with the standard requirements of the Coast Guard and the American Bureau of Shipping. Moreover, said storage containing apparatus of the present invention is DNV 2.7-1 certified, thus complying with worldwide requirements for offshore cargo containing/shipping units.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
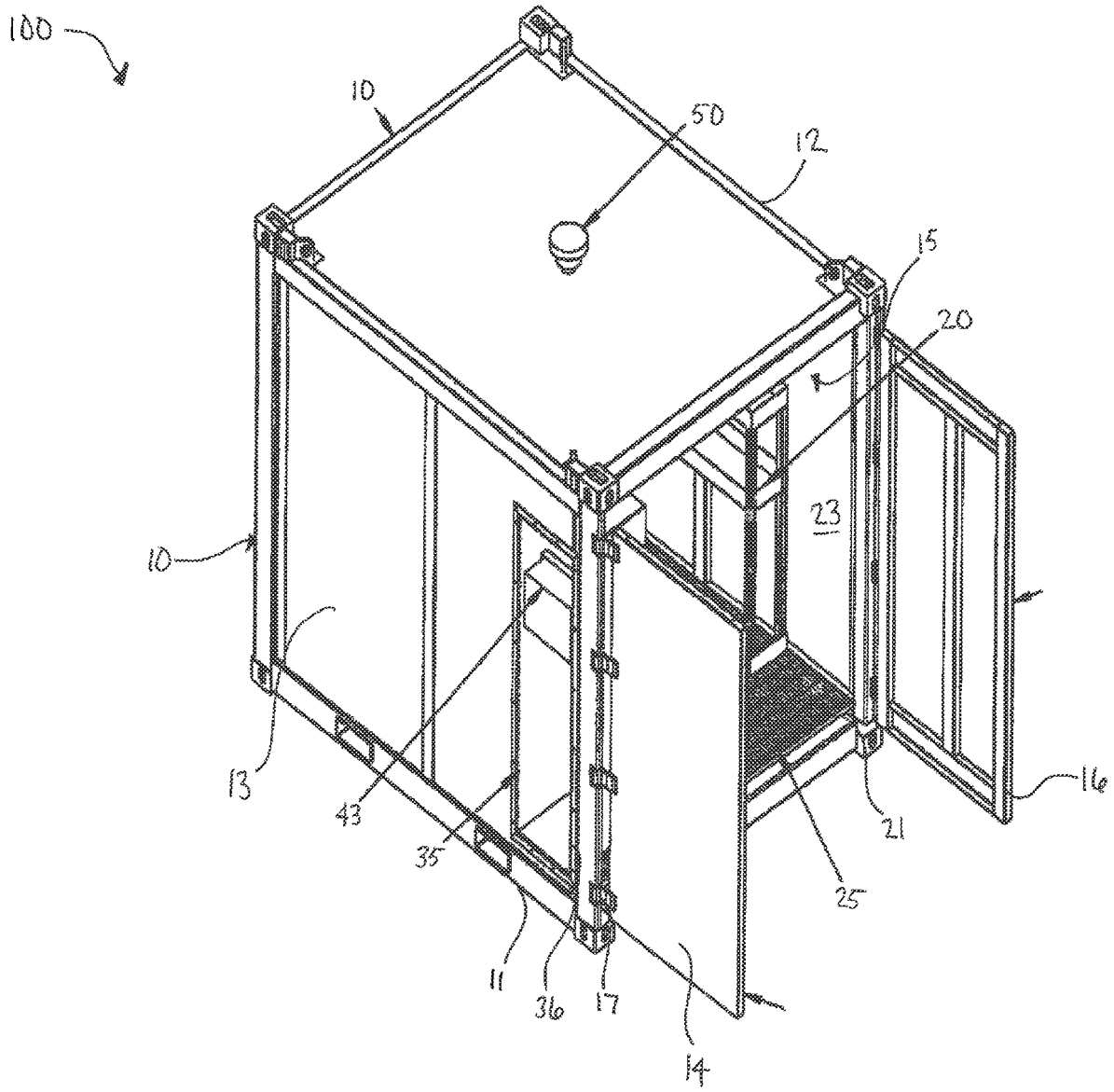
FIG. 1 depicts a perspective view of a preferred embodiment of a portable storage containing apparatus of the present invention.

Referring to the drawings, FIG. 1 depicts a perspective view of a portable storage containing apparatus 100 of the present invention in a fully constructed configuration, generally comprising a container member 10. Portable storage containing apparatus 100 of the present invention can be manufactured from a substantially rigid material, such as, for example, a galvanized steel material, or any other similar material exhibiting like characteristics, in order to prevent corrosion and rusting. Additionally, portable storage containing apparatus 100 can be manufactured in a variety of different dimensions. By way of illustration, but not limitation, said portable storage containing apparatus 100 of the present invention can be manufactured in an approximately eight (8') feet by ten (10') feet DNV 2.71 galvanized conex box-like structure. Moreover, said storage apparatus 100 can further comprise a means to store a variety of different sizes of buckets, cans, containers, etc. having sensitive and/or flammable materials.

Said portable storage containing apparatus 100 of the present invention generally comprises a container member 10, having a substantially planar base member 11, a substantially planar top member 12, a plurality of substantially planar side wall members 13, and a plurality of substantially planar end members 14. Base member 11 and top member 12 are oriented substantially parallel to each other, while side members 13 are oriented substantially parallel to each other; end members 14 are oriented substantially parallel to each other and in a substantially perpendicular orientation to side members 13. Thus, side walls 13 and end members 14 attachably connect and adjoin said base 11 to said top 12; thus, base 11, top 12, sides 13 and ends 14 cooperate to form an enclosed box-like configuration having an inner space, or chamber 15.

In a preferred embodiment, at least one end member 14 comprises a door 16 that can be opened and/or closed as necessary, thereby allowing a user to beneficially add or remove a plurality of contents from within inner chamber 15 of container member 10. Door 16 comprises a plurality of hinges 17 that hingedly connect said end member 14 to said side members 13. As such, hinges 17 allow door 16 to beneficially open in a substantially outward direction from said container member 10 whenever contents need to be added or removed from said container member 10. Moreover, an interior surface 21 of base 11 member within inner chamber 15 of container member comprises a grating 25, or a containment floor, for use in safely containing any liquids or fluids that may have spilled onto said grating 25, or a floor surface.

Inner chamber 15 of container member 10 further comprises a shelving unit 20, wherein said shelving unit 20 generally comprises a plurality of levels—typically three (3)—that can be attachably mounted to an interior surface 23 of said side walls 13 of said container member 10. Said shelving unit 20 can be manufactured from a substantially durable material, such as, for example, an aluminum material, or any other similar material exhibiting like characteristics.

A fixed fire extinguishing system can be installed on an exterior surface of said container member 10 of portable storage containing apparatus 100 of the present invention by way of a plurality of nuts and bolts that securely attach said system to said container member 10. In a preferred embodiment, side member 13 comprises a recessed cavity 30, wherein said cavity 30 extends in a substantially inward direction towards said inner chamber 15. Said recessed cavity 30 comprises a fire suppression releasing cabinet 35, or system, wherein said fire suppression system allows for said device of the present invention to achieve manually activated localized fire extinguishment. Said cabinet 35 comprises galvanized piping that is mounted to a top end 36 of said releasing cabinet 35, wherein said piping is extended to a top 12 and an opposite end of said container member 10.

Still referring to FIG. 1, portable storage containing apparatus 100 further comprises a carbon dioxide system or assembly 40 located within said releasing cabinet 35 of said container member 10. By way of illustration, but not limitation, said carbon dioxide system 40 can comprise a Kidde Fire Systems Marine Carbon Dioxide System, which is for all purposes incorporated herein by reference. It is to be observed that alternate means of carbon dioxide release and discharge into and within portable storage containing apparatus may also be used, as necessary. In operation, said carbon dioxide system 40 releases gaseous carbon dioxide to rapidly suppress a fire by a combination of cooling and oxygen displacement. Said carbon dioxide system 40 generally comprises a plurality of component parts, such as, for example, a carbon dioxide cylinder 41, a plurality of check valves 42, a control unit 43, a manual system activation, a pressure safety valve 44, a plurality of discharge nozzles 45, and a time delay cylinder 46, wherein said component parts are generally mounted to a rear end 14 of said container 10.

Said carbon dioxide cylinder 41 is positioned into a substantially elevated and substantially square shaped bottle rack base that is fixedly attached to an exterior surface of side wall 13 of container member 10. Said cylinder 41 is then oriented in a position for connection to said fire suppression system, wherein said cylinder 41 connects to both a cable operated control head 43 and a substantially flexible hose. A discharge head of said carbon dioxide cylinder 41 comprises a threaded connection, wherein said flexible hose is able to attachably connect to said discharge head of said carbon dioxide cylinder 41. Said discharge head is to be installed within an inner chamber 15 of said container member 10 by way of positioning said discharge head on a top end of said carbon dioxide cylinder 41 and a valve assembly. Said cable operated control head is attachably connected to said valve assembly, and a safety pin is then inserted into said cable operated control head. Additionally, said valve assembly comprises a handle, wherein turning said handle to a desired position can either open or close said flow valve, as necessary.

Portable storage containing apparatus 100 of the present invention further comprises a flame arrestor 50 that allows gas to pass through said flame arrestor 50 but stops a flame in order to prevent a larger fire or explosion. As such, flame arrestor 50 is intended to prevent the passage of flame, while simultaneously allowing for free ventilation. By way of illustration, but not limitation, flame arrestor 50 can comprise an Enardo Vent Stack Flame Arrestor, which is for all purposes incorporated herein by reference. It is to be observed that alternate means of arresting a flame within portable storage containing apparatus 100 may also be used, as necessary.

Activation of said fire extinguishing system of said storage containing apparatus 100 of the present invention is generally achieved manually by way of engaging said releasing cabinet 35. Said releasing cabinet 35 is typically engaged by pulling an activator handle located on control panel 43, wherein an alarm and carbon dioxide fire suppression system 40 are then able to activate carbon dioxide discharge.

Referring to FIG. 1, in a preferred embodiment, when a fire occurs within said inner chamber 15 of said portable storage containing apparatus 100, said fire extinguishing system must be manually activated by an on-site personnel operator. Operator will close said doors 16 to said container member 10, and then approach said releasing cabinet 35 that is located on an exterior surface of a side wall 13 of said device 100. Operator will open a cabinet door 36 of said releasing cabinet 35 by way of unlatching a plurality of top mounted latches. Operator will then pull a first handle located within said control unit 43 labeled "Command 1" in a relatively outward direction away from said cabinet 35 in order to open said stop valves. An alarm will begin to activate, and operator will then be able to remove a safety bolt pin from a bracket by sliding said pin out of said releasing cabinet 35. Operator will then pull a second handle labeled "Command 2" in a relatively outward direction away from said cabinet 35 in order to activate carbon dioxide discharge from said carbon dioxide system 40.

In an alternate embodiment, storage containing apparatus 100 comprises a back-up method of manual activation for said fire suppression system. In the event said releasing cabinet 35 fails to engage, said fire suppression system must be manually activated, wherein a safety pin from a manual activation valve located on a carbon dioxide bottle 41 will be removed and an additional handle will be pulled in order to engage the carbon dioxide fire suppression system 40, thereby activating carbon dioxide discharge, which in turn will ultimately suppress a fire within said inner chamber 15 of said container 10 of the present invention.

Figure 2:
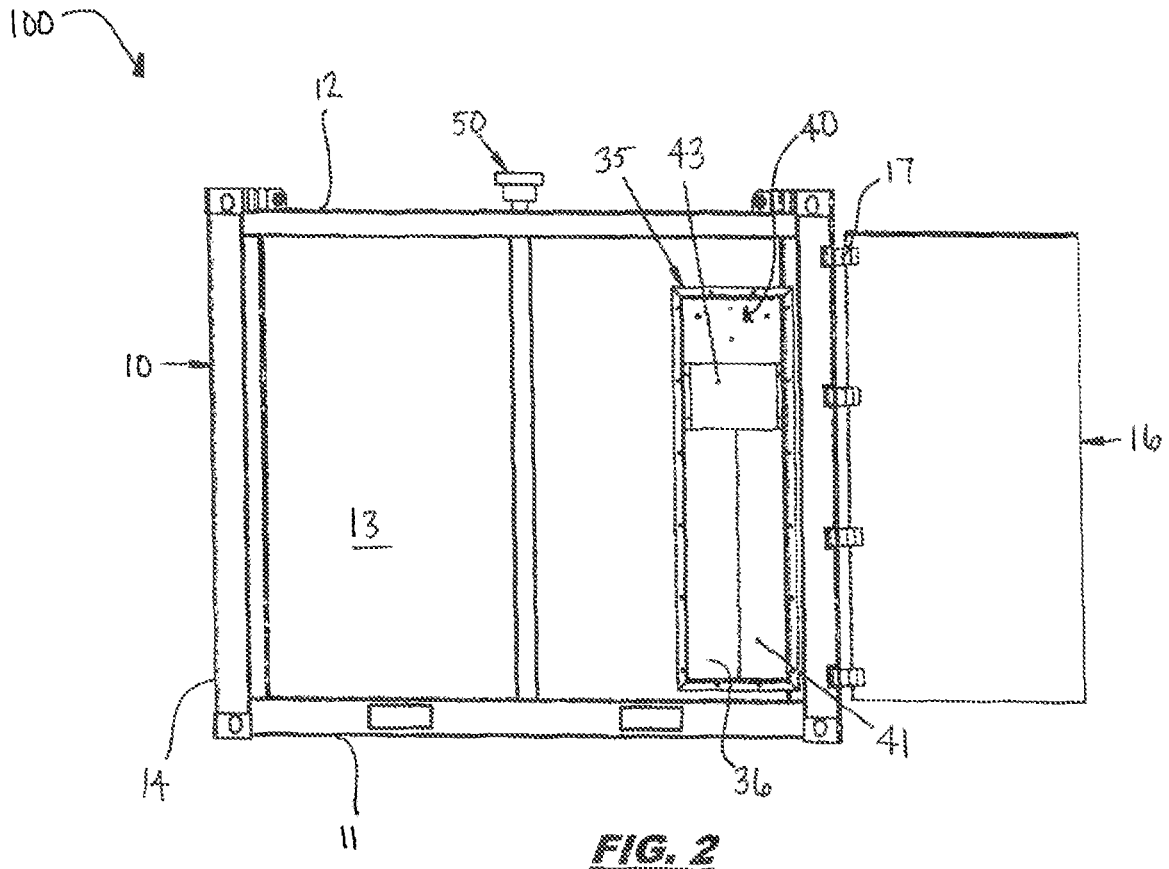
FIG. 2 depicts a side view of a preferred embodiment of a portable storage containing apparatus of the present invention.

FIG. 2 depicts a side view of portable storage containing apparatus of the present invention generally comprising container member 10 having releasing cabinet 35. Container member 10 comprises substantially planar base member 11, substantially planar top member 12, substantially planar side wall members 13, and substantially planar end members 14. Base member 11 and top member 12 are oriented substantially parallel to each other, while side members 13 are oriented substantially parallel to each other; end members 14 are oriented substantially parallel to each other and in a substantially perpendicular orientation to side members 13. Thus, side walls 13 and end members 14 attachably connect and adjoin said base 11 to said top 12; thus, base 11, top 12, sides 13 and ends 14 cooperate to form an enclosed box-like configuration having an inner space, or chamber 15.

At least one end member 14 comprises door 16 that can be opened and/or closed as necessary, thereby allowing a user to beneficially add or remove a plurality of contents from within inner chamber 15 of container member 10. Door 16 comprises a plurality of hinges 17 that hingedly connect said end member 14 to said side members 13. As such, hinges 17 allow door to beneficially open in a substantially outward direction from said container member 10 whenever contents need to be added or removed from said container member 10. Moreover, an interior surface 21 of base 11 member within inner chamber 15 of container member comprises a grating 25, or a containment floor, for use in safely containing any liquids or fluids that may have spilled onto said grating 25, or a floor surface.

A fixed fire extinguishing system can be installed on an exterior surface of said container member 10 of portable storage containing apparatus of the present invention by way of a plurality of nuts and bolts that securely attach said system to said container member 10. In a preferred embodiment, side member 13 comprises a recessed cavity 30, wherein said cavity 30 extends in a substantially inward direction towards said inner chamber 15. Recessed cavity 30 comprises a fire suppression releasing cabinet 35, or system, wherein said fire suppression system allows for said device 100 of the present invention to achieve manually activated localized fire extinguishment.

Cabinet 35 comprises an exterior fiberglass door 36 for use in enclosing and protecting carbon dioxide system 40 within said cabinet 35 as discussed herein. Said cabinet door 36 further comprises a weather seal and a plurality of latches for use in opening and/or closing said cabinet door 36. Additionally, cabinet 35 comprises galvanized piping that is mounted to a top end of said releasing cabinet 35, wherein said piping is extended to top 12 and an opposite end of container member 10.

Still referring to FIG. 2, portable storage containing apparatus 100 further comprises carbon dioxide system 40 located within releasing cabinet 35 of container member 10. By way of illustration, but not limitation, carbon dioxide system 40 can comprise a Kidde Fire Systems Marine Carbon Dioxide System, which is for all purposes incorporated herein by reference. It is to be observed that alternate means of carbon dioxide release and discharge into and within portable storage containing apparatus 100 may also be used, as necessary. In operation, carbon dioxide system 40 releases gaseous carbon dioxide to rapidly suppress a fire by a combination of cooling and oxygen displacement. Carbon dioxide system 40 generally comprises a plurality of component parts, such as, for example, a carbon dioxide cylinder 41, a plurality of check valves 42, a control unit 43, a manual system activation, a pressure safety valve 44, a plurality of discharge nozzles 45, and a time delay cylinder 46, wherein said component parts are generally mounted to a rear end 14 of said container 10.

Said carbon dioxide cylinder 41 is positioned into a substantially elevated and substantially square shaped bottle rack base that is fixedly attached to an exterior surface of side wall 13 of container member 10. Said cylinder 41 is then oriented in a position for connection to said fire suppression system, wherein said cylinder 41 connects to both a cable operated control head and a substantially flexible hose. A discharge head of said carbon dioxide cylinder 41 comprises a threaded connection, wherein said flexible hose is able to attachably connect to said discharge head of said carbon dioxide cylinder 41. Said discharge head is to be installed within inner chamber 15 of container member 10 by way of positioning said discharge head on a top end of said carbon dioxide cylinder 41 and a valve assembly. Said cable operated control head is attachably connected to said valve assembly, and a safety pin is then inserted into said cable operated control head. Additionally, said valve assembly comprises a handle, wherein turning said handle to a desired position can either open or close said flow valve, as necessary.

Figure 3:
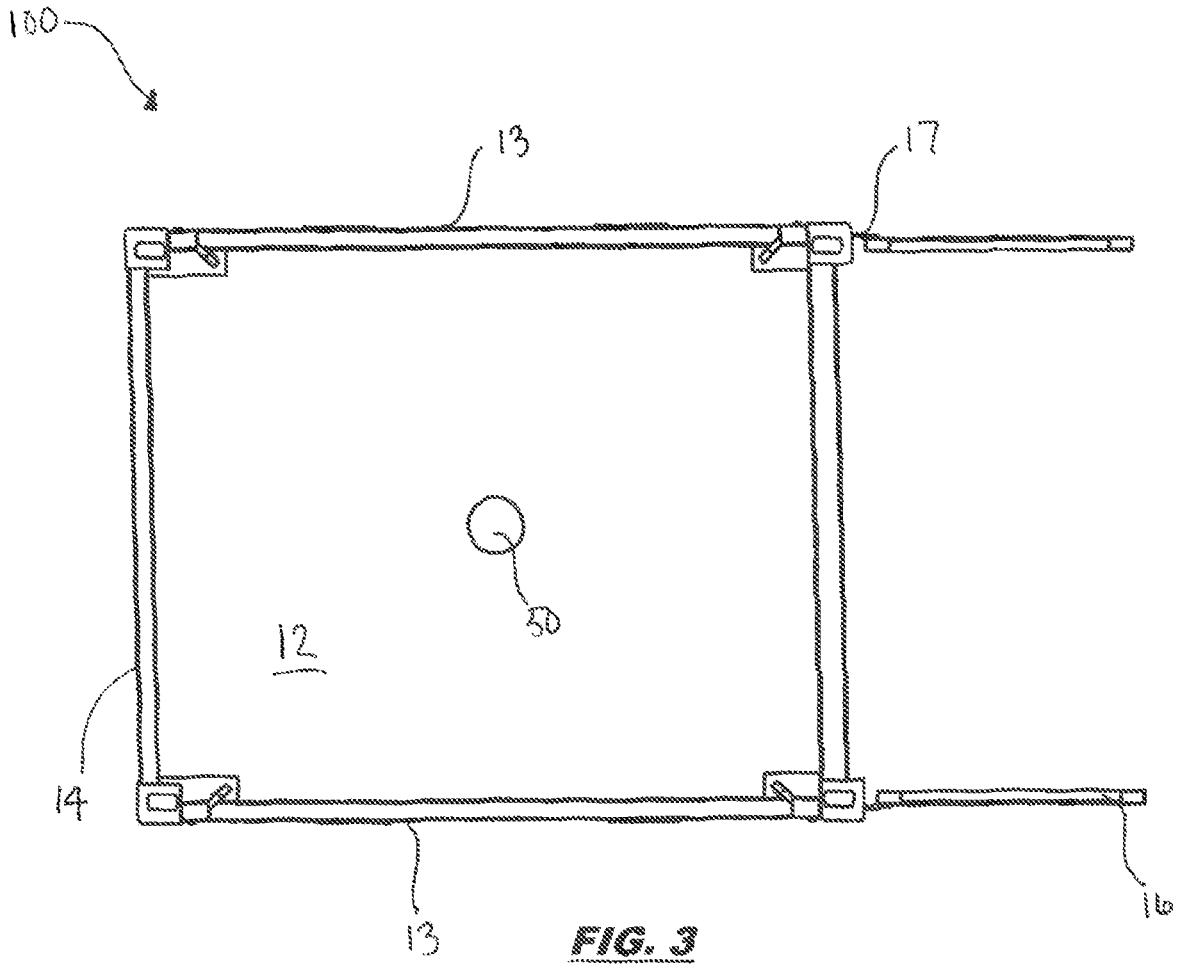
FIG. 3 depicts an aerial view of a preferred embodiment of a portable storage containing apparatus of the present invention.

FIG. 3 depicts an aerial view of portable storage containing apparatus 100 of the present invention generally comprising flame arrestor 50, wherein flame arrestor 50 is located on top end 12 of container member 10. Flame arrestor 50 is intended to prevent the passage of flame, while simultaneously allowing for free ventilation. By way of illustration, but not limitation, flame arrestor 50 can comprise an Enardo Vent Stack Flame Arrestor, which is for all purposes incorporated herein by reference. It is to be observed that alternate means of arresting a flame within portable storage containing apparatus 100 may also be used, as necessary.

Figure 4:
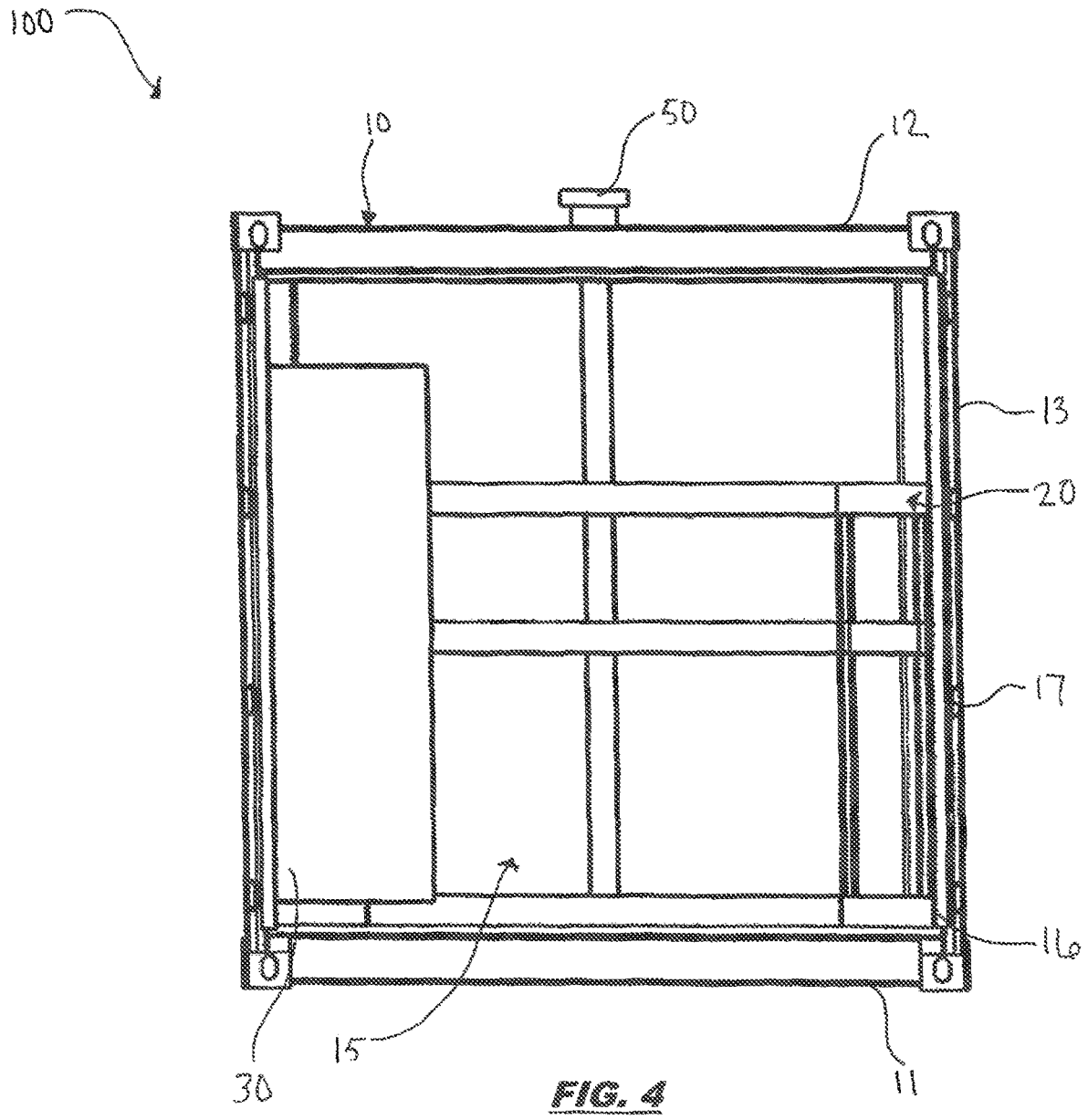
FIG. 4 depicts an end view of a preferred embodiment of a portable storage containing apparatus of the present invention.

FIG. 4 depicts an end view of portable storage containing apparatus 100 of the present invention in an open configuration. Container member 10 comprises at least one end member 14 having door 16 that can be opened and/or closed as necessary, thereby allowing a user to beneficially add or remove a plurality of contents from within inner chamber 15 of container member 10. Door 16 comprises hinges 17 that hingedly connect said end member 14 to said side members 13. As such, hinges 17 allow door 16 to beneficially open in a substantially outward direction from said container member 10 whenever contents need to be added or removed from said container member 10.

Inner chamber 15 of container member 10 comprises shelving unit 20, wherein said shelving unit 20 generally comprises a plurality of levels that can be attachably mounted to an interior surface 23 of said side walls 13 of said container member 10. Said shelving unit 20 can be manufactured from a substantially durable material, such as, for example, an aluminum material, or any other similar material exhibiting like characteristics. Moreover, shelving unit 20 of inner chamber 15 can further comprise a means to store a variety of different sizes of buckets, cans, containers, etc. having sensitive and/or flammable materials. By way of illustration, but not limitation, a bottom shelf is designed and able to properly store a five (5) gallon bucket, and a middle and a top shelf are designed and able to properly store a one (1) gallon paint container or bucket.

In a preferred embodiment, side member 13 comprises a recessed cavity 30, wherein said cavity 30 extends in a substantially inward direction towards said inner chamber 15. Said recessed cavity 30 comprises a fire suppression releasing cabinet 35, or system, wherein said releasing cabinet 35 houses said carbon dioxide system 40. When a fire ignites within said inner chamber 15, release cabinet 35, and thus carbon dioxide system 40, is manually activated, wherein carbon dioxide will be discharged into inner chamber 15 of storage containing apparatus 100, thereby extinguishing and thus suppressing said fire.

Figure 5:
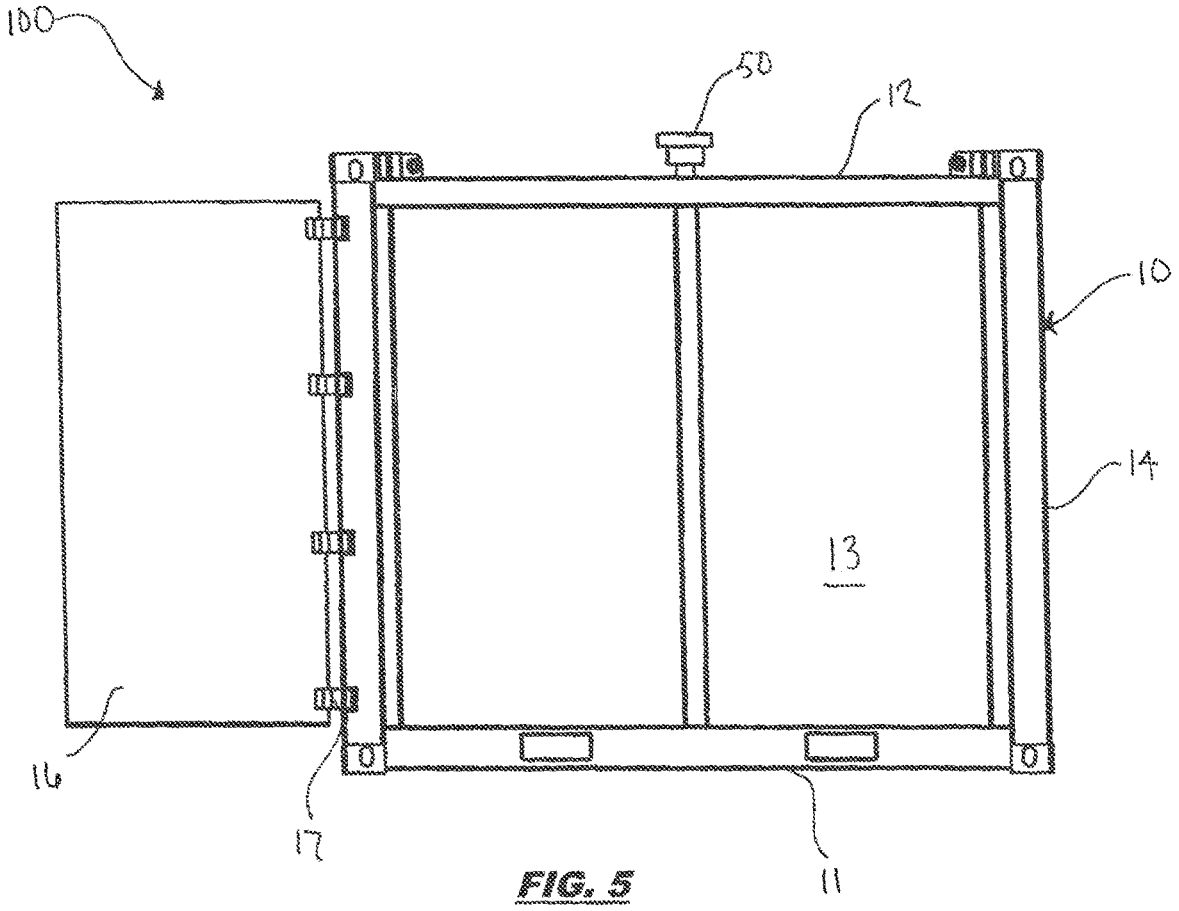
FIG. 5 depicts an alternate side view of a preferred embodiment of a portable storage containing apparatus of the present invention.
Figure 6:
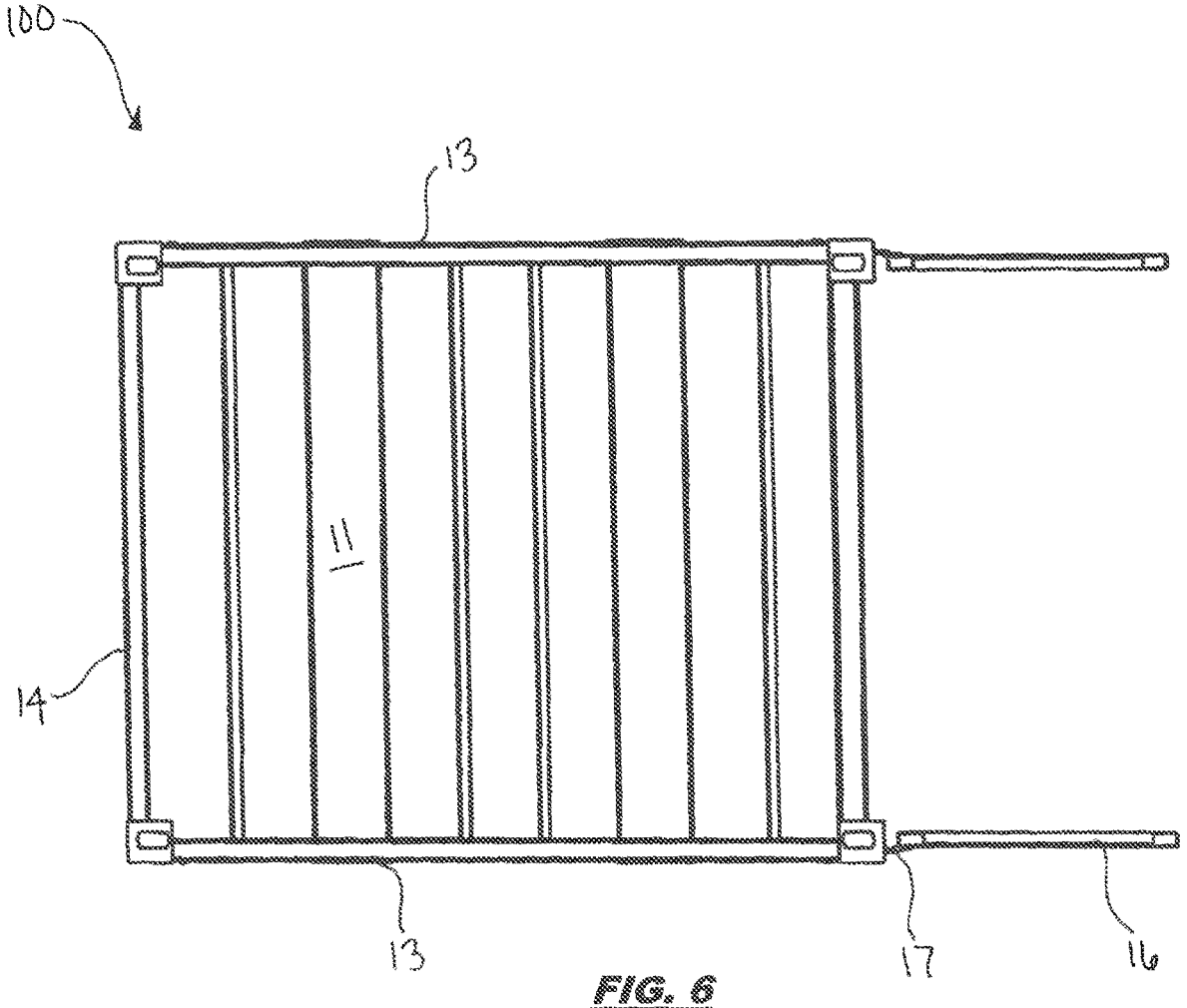
FIG. 6 depicts a bottom view of a preferred embodiment of a portable storage containing apparatus of the present invention.

FIG. 5 depicts an alternate side view of portable storage containing apparatus 100 of the present invention. FIG. 6 depicts a bottom view of portable storage containing apparatus 100 of the present invention comprising container member 10, having base 11, top 12, sides 13, and ends 14. Ends 14 are hingedly attached to sides 13, thereby forming door members 16 for use in opening and/or closing said container member 10, as necessary.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method of manually activating fire suppression and extinguishment within a portable offshore storage container apparatus comprising:

a) closing a door to a container member of said portable offshore storage container apparatus, wherein said portable offshore container apparatus comprises:

i) said container member having a base, a top, a plurality of sides, and a plurality of ends, wherein said base, said top, said sides, and said ends cooperate to form an inner chamber;

ii) a fire extinguishing system comprising a recessed cavity that extends in a substantially inward direction into said inner chamber of said container member, wherein said recessed cavity houses a cabinet member;

iii) wherein said fire extinguishing system further comprises a carbon dioxide fire suppression assembly located within said cabinet member, wherein said carbon dioxide fire suppression assembly comprises a carbon dioxide cylinder, a control unit, a plurality of valves, and a plurality of nozzles for carbon dioxide discharge;

b) opening a door located on said cabinet member;

c) pulling a first handle on said control unit in a substantially outward direction away from said cabinet member in order to open said valves; and d) pulling a second handle on said control unit in a substantially outward direction away from said cabinet member in order to activate carbon dioxide discharge from said cylinder of said carbon dioxide fire suppression assembly.

2. The method of claim 1, wherein said inner chamber further comprises a shelving unit for use in storing a variety of different flammable and sensitive materials.

3. The method of claim 1, further comprising a flame arrestor located on said top of said container member.

* * * * *